US008567492B2

(12) United States Patent
White

(10) Patent No.: US 8,567,492 B2
(45) Date of Patent: Oct. 29, 2013

(54) MODIFIED PACKER WITH NON-EXTRUSION RING

(71) Applicant: Max White, Arlington, TX (US)

(72) Inventor: Max White, Arlington, TX (US)

( * ) Notice: Subject to any disclaimer, the term of this patent is extended or adjusted under 35 U.S.C. 154(b) by 0 days.

(21) Appl. No.: 13/730,173

(22) Filed: Dec. 28, 2012

(65) Prior Publication Data

US 2013/0112398 A1 May 9, 2013

Related U.S. Application Data

(63) Continuation-in-part of application No. 13/436,586, filed on Mar. 30, 2012, now Pat. No. 8,381,809, and a continuation of application No. 12/559,283, filed on Sep. 14, 2009, now Pat. No. 8,167,033.

(51) Int. Cl.
*E21B 33/128* (2006.01)

(52) U.S. Cl.
USPC ..... 166/196; 166/134; 277/338; 277/339; 277/342; 277/533; 277/619; 277/638

(58) Field of Classification Search
USPC ..... 166/134, 179, 187, 196, 387; 277/337, 277/338, 339, 340, 341, 342, 531, 532, 533, 277/619, 638
See application file for complete search history.

(56) References Cited

U.S. PATENT DOCUMENTS

| | | | | |
|---|---|---|---|---|
| 2,430,623 | A | 11/1947 | Taylor, Jr. et al. | |
| 2,449,514 | A * | 9/1948 | Scoville, Jr. | 277/341 |
| 2,797,758 | A | 7/1957 | Showalter | |
| 2,921,633 | A * | 1/1960 | Baker | 277/338 |
| 3,776,561 | A | 12/1973 | Haney | |
| 4,452,463 | A | 6/1984 | Buckner | |
| 6,578,638 | B2 | 6/2003 | Guillory et al. | |

* cited by examiner

*Primary Examiner* — William P Neuder
*Assistant Examiner* — Richard Alker
(74) *Attorney, Agent, or Firm* — Shannon W. Bates; Klemchuk Kubasta LLP

(57) ABSTRACT

Embodiments of the present disclosure generally provide a packer for use within a conduit, such as casing, having non-extrusion rings. The non-extrusion ring is comprised of rigid segments, a support ring and an elastic matrix.

20 Claims, 10 Drawing Sheets

MODIFIED PACKER WITH NON-EXTRUSION RING

CROSS REFERENCE TO RELATED APPLICATIONS

The present application is a continuation-in-part of U.S. patent application Ser. No. 13/436,586, filed Mar. 30, 2012 and entitled "Packer with Non-Extrusion Ring", now U.S. Pat. No. 8,381,809 which is a continuation of U.S. patent application Ser. No. 12/559,283, filed Sep. 14, 2009 and entitled "Packer with Non-Extrusion Ring", now U.S. Pat. No. 8,167,033, each of which is incorporated herein by reference for all purposes.

TECHNICAL FIELD

The disclosure relates generally to down-hole equipment, and in particular to a packer with a non-extrusion ring.

BACKGROUND

Packers are used to seal portions of conduit, such as casing, against fluid flow. Such devices are common in oil and gas wells, but may be used in other types of conduit as well.

SUMMARY

Embodiments of the present disclosure generally provide a packer system for use within a conduit, such as casing, having non-extrusion rings which allow for a more efficient assembly and conveyance, thereby substantially improving the stability of the packing unit and creating a more reliable seal.

In an embodiment, the present disclosure provides a packer system comprising a mandrel, a plurality of slips securing the mandrel to the casing, at least one forcing cone slidable along the mandrel, two non-extrusion rings and two sets of support rings. Each non-extrusion ring may include a plurality of rigid segments arranged in a vertically overlapping manner bonded together and enveloped by a elastomeric matrix. A support ring is placed on each end of the principal element, between the principal element and a non-extrusion ring. According to one embodiment, when engaged, the rigid segments of the non-extrusion ring expand towards the casing to form a seal.

In another embodiment of the present disclosure, the packer system may comprise a mandrel, a plurality of slips securing the mandrel to the casing, at least one forcing cone slidable along the mandrel and two non-extrusion rings at each end of the principal element. Each non-extrusion ring may include a plurality of rigid segments arranged in a vertically overlapping manner and a conical supporting ring, bonded together and enveloped by an elastomeric matrix. According to one embodiment, when engaged, the rigid segments of the non-extrusion ring expand towards the casing to form a seal.

Other technical features may be readily apparent to one skilled in the art from the following figures, descriptions and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

The present disclosure generally provides a packer 10 for use within a conduit 12, such as casing, having non-extrusion rings 14.

Figure 1:
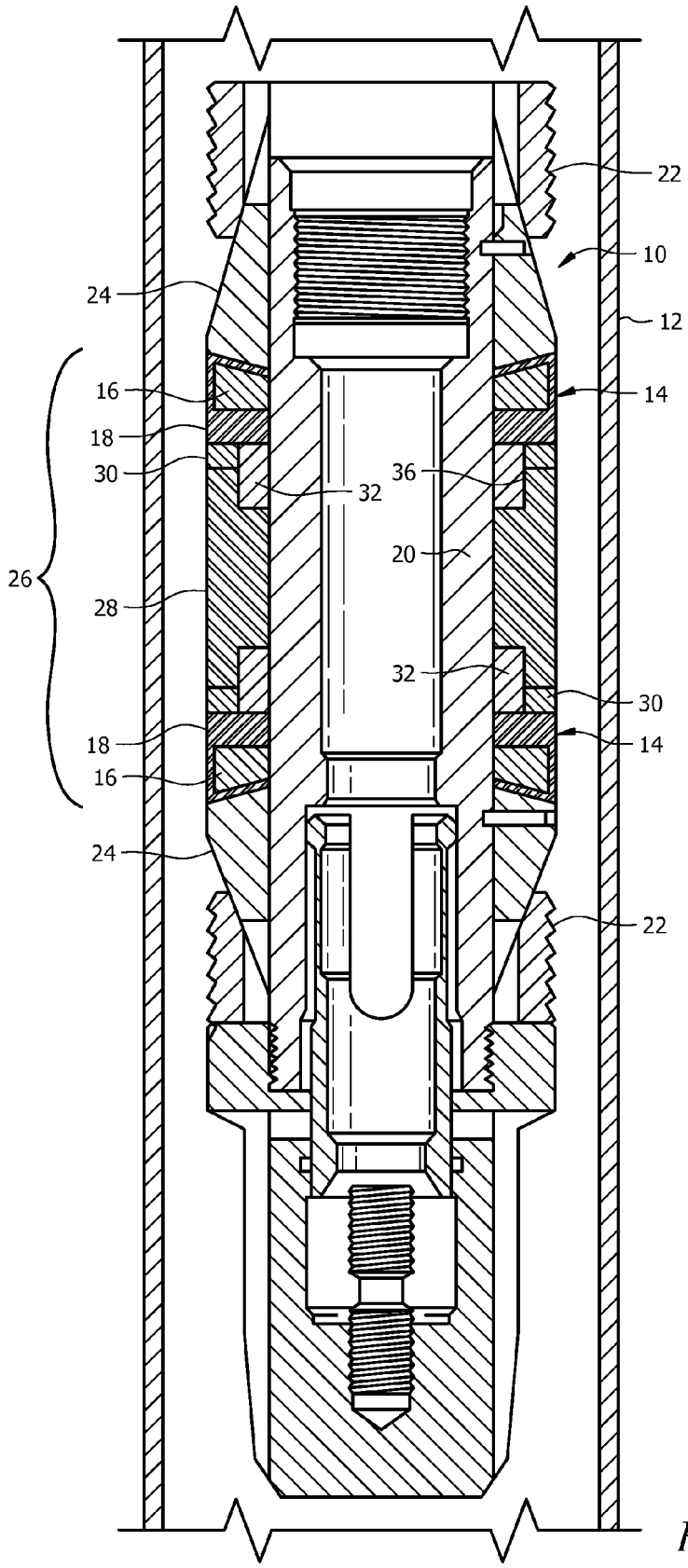
FIG. 1 is a sectional view of a packer in a retracted state according to one embodiment of the present disclosure.

FIG. 1 is a sectional view of a packer 10 in a refracted state. Packer 10 has a central mandrel 20 and slips 22 to secure packer 10 within conduit 12. Forcing cones 24 move axially along mandrel 20. Between forcing cones 24 is a packing element 26. Packing element 26 is comprised of a principal element 28 with a support ring 30, inner ring 32 and a non-extrusion ring 14 on each end. Principal element 28 is an elastomeric seal with a recess 36 in each end. Recess 36 is sized to accommodate inner ring 32 while the packer 10 is in a refracted state.

Figure 2:
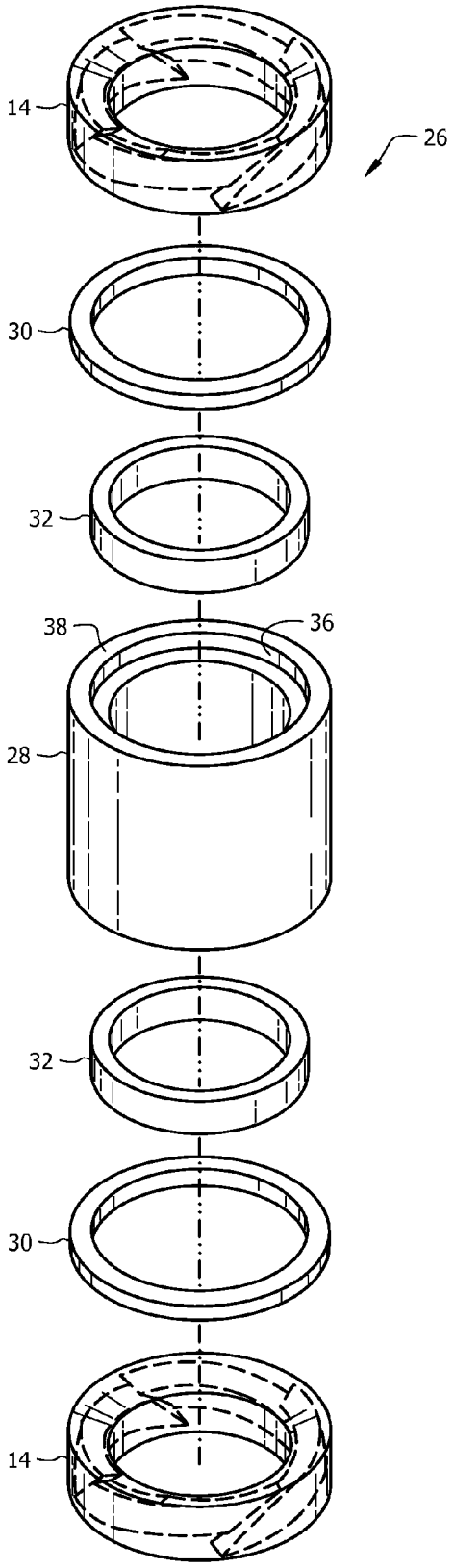
FIG. 2 is an exploded view of a packing element according to one embodiment of the present disclosure.

FIG. 2 is an exploded view of packing element 26 according to one embodiment of the present disclosure. In the middle of the packing element 26 is principal element 28. In this view recess 36 is shown extending around the interior of the principal element 28 creating a shoulder 38 on each end of the principal element 26. Inner ring 32 sits inside of shoulder 38, within recess 36, while support ring 30 sits on shoulder 38. Inner ring 32 is sized to slide within support ring 30 and recess 36 is sized to allow inner ring 32 to be flush with support ring 30 when the packing element 26 is assembled as shown in FIG. 3.

FIG. 2 shows that each end of packing element 26 has the same structure: the non-extrusion ring 14, the support ring 30 and the inner ring 32.

Figure 3:
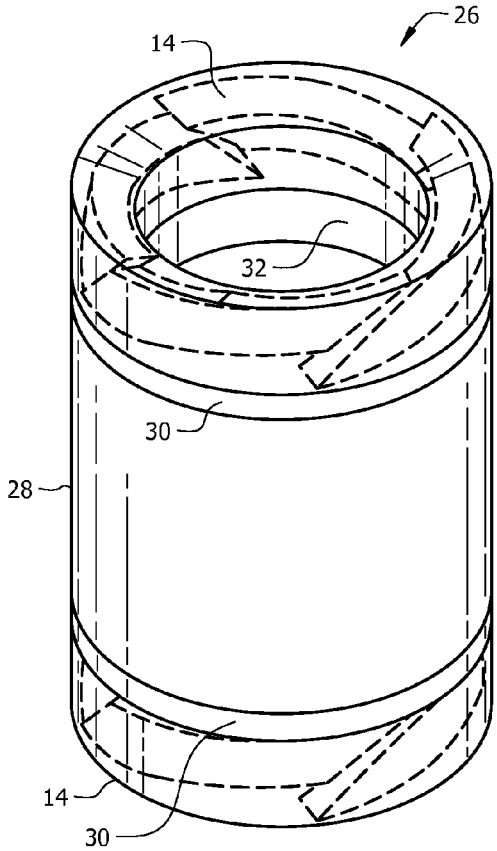
FIG. 3 is an assembled view of the packing element of FIG. 2.

FIG. 3 is an assembled view of the packing element 26 of FIG. 2. The assembled packing element 26 shows the relationship of the various parts of FIG. 2 when placed into a packer 10.

Figure 4A:
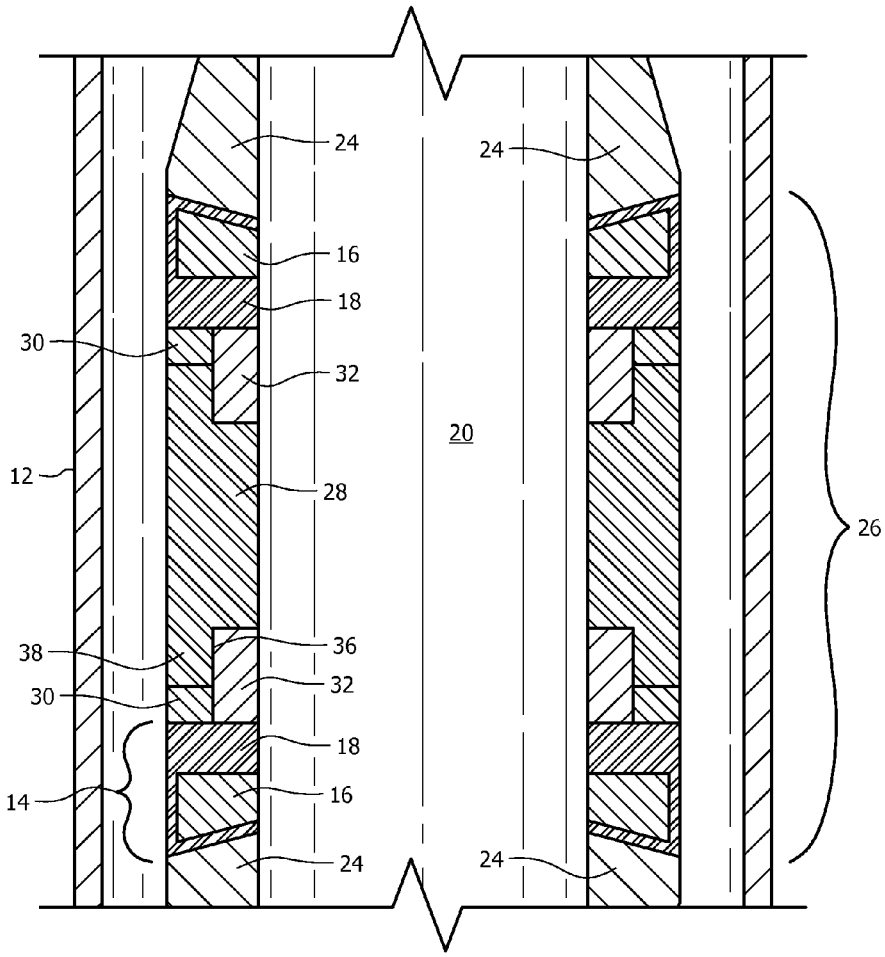
FIG. 4A is a sectional close-up view of a packing element in a retracted state according to one embodiment of the present disclosure.

FIG. 4A is a sectional close-up view of a packing element 26 in a retracted state within a packer 10 according to one embodiment of the present disclosure. Principal element 28 is shown with inner ring 32 within recess 36 and support ring 30 on shoulder 38, support ring 30 and inner ring 32 being flush with one another where they meet non-extrusion ring 14. Non-extrusion ring 14 has a slanted face adjacent to forcing cone 24. Non-extrusion ring 14 has rigid segments 16 within an elastomeric matrix 18.

Figure 4B:
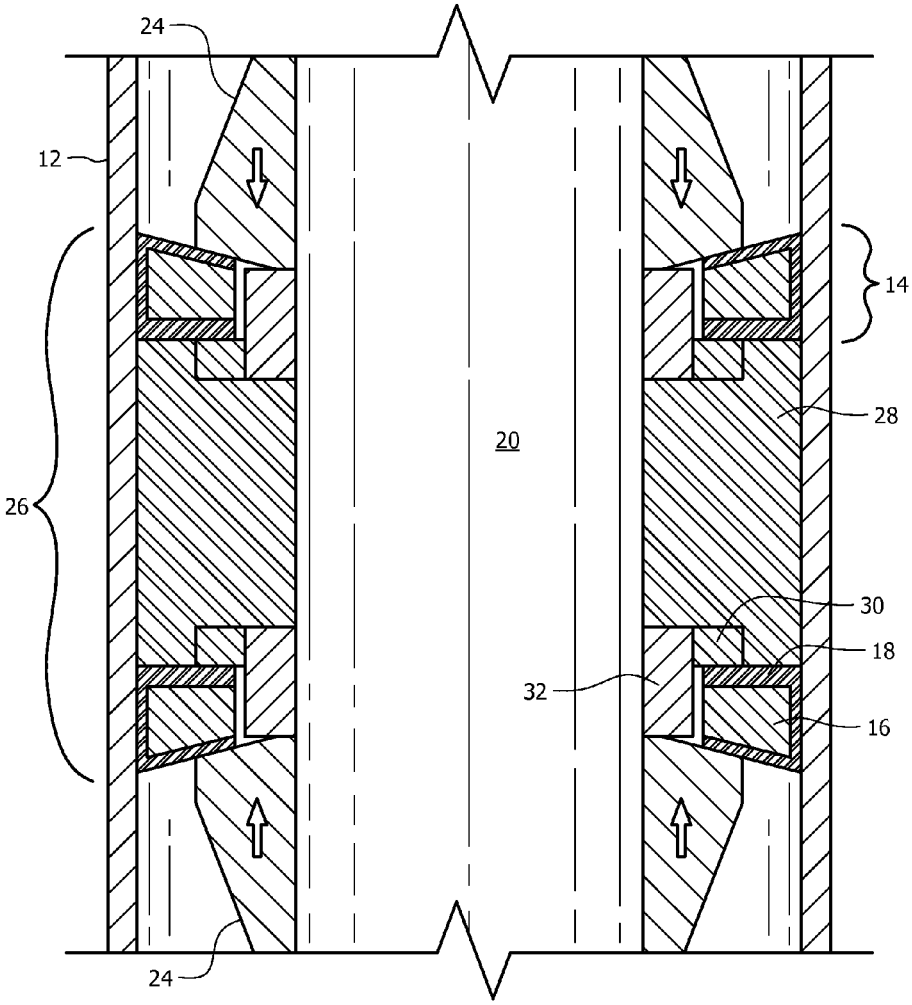
FIG. 4B is a sectional close-up view of a packing element in an engaged state according to one embodiment of the present disclosure.

FIG. 4B is a sectional close-up view of a packing element 26 in an engaged state where forcing cones 24 are moved axially along the mandrel 20 towards each other according to one embodiment of the present disclosure. The inclined planes of the forcing cones 24 have pushed the non-extrusion rings 14 out to the conduit 12 and the pressure on principal element 28 has squeezed principal element 28 out into engagement with the conduit 12 as well. Under this pressure, inner ring 32 slides within support ring 30 to abut forcing cone 24. Inner ring 32, support ring 30 and non-extrusion ring 14 form a seal between mandrel 20 and conduit 12 to contain principal element 28 from extruding between the forcing cones 24 and the conduit 12.

Figure 5:
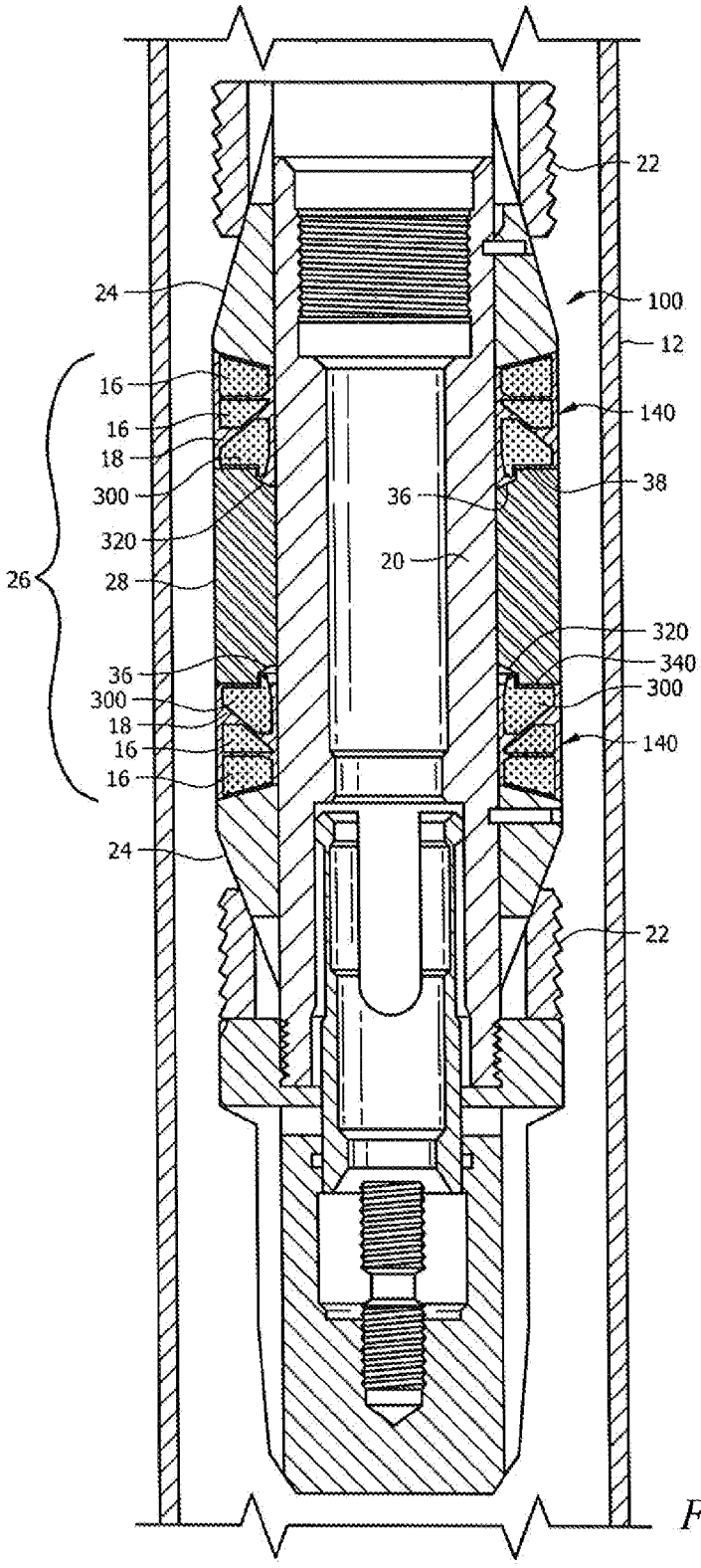
FIG. 5 is a sectional view of a packer in a retracted state according to a second embodiment of the present disclosure.

FIG. 5 is a sectional view of a packer 100 in a retracted state according to a second embodiment of the present disclosure. Packer 100 shares many of the same features as packer 10, so like elements retain like reference numerals. Packer 100 has a central mandrel 20 and slips 22 to secure packer 100 within conduit 12. Forcing cones 24 move axially along mandrel 20. Between the forcing cones 24 is a three-piece packing element 26. Three-piece packing element 26 is comprised of a principal element 28 with a non-extrusion ring 140 at each end.

In embodiments of the present disclosure, non-extrusion ring 140 may include rigid segments 16 and a conical support ring 300, bonded together and affixed by elastomeric matrix 18 to form an integral unit as shown assembled in FIG. 5. Rigid segments 16 may be arranged in a vertically overlapping manner and may have angled ends such that, when engaged, each rigid segment 16 may be slidably disposed against another rigid segment 16 to form a rigid ring. Rigid segments 16 are supported by and rest on conical support ring 300. The exterior surface of non-extrusion ring 140, having an angled protruding shoulder 320 and a flat base 340, engages the principal element 28.

As shown in FIG. 5, the principal element 28 is an elastomeric seal with a shoulder 38 and a recess 36 in each end. Recess 36 is sized to accommodate the angled protruding shoulder 320 of the non-extrusion ring 140, such that the angled protruding shoulder 320 fixedly secures non-extrusion ring 140 to the principal element 28, while the packer 100 is in a refracted state.

Figure 6A:
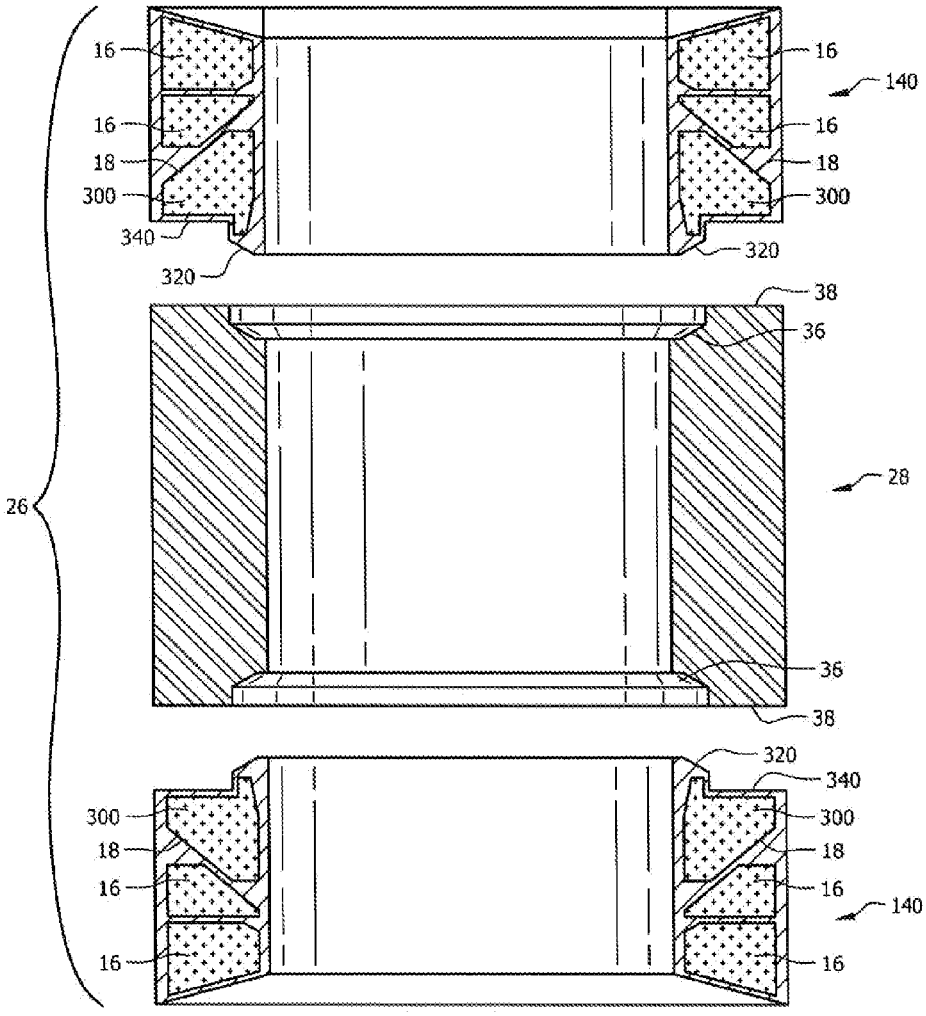
FIG. 6A is an exploded view of a packing element according to a second embodiment of the present disclosure.

FIG. 6A is an exploded view of a packing element 26 according to a second embodiment of the present disclosure. Principal element 28 forms the center of packing element 26. The interior end of each non-extrusion ring 140 encompasses the conical support ring 300 affixed by elastomeric matrix 18. In this view, recess 36 is shown extending around the interior of the principal element 28 creating the shoulder 38 on each end of the principal element 28. The flat base 340 of non-extrusion ring 140 sits flush against shoulder 38 and angled protruding shoulder 320 of non-extrusion ring 140 fixedly slides within recess 36 when the packing element 26 is assembled as shown in FIG. 6A.

Figure 6B:
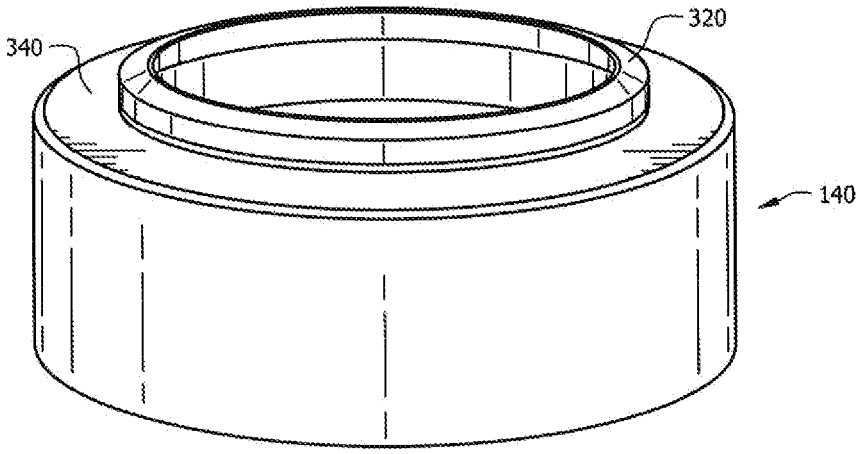
FIG. 6B is an isometric view of a non-extrusion ring of a packing element according to a second embodiment of the present disclosure.

FIG. 6B is an isometric view of the non-extrusion ring 140 of FIG. 6A, further illustrating the flat base 340, which engages the shoulder 38 of the principal element 28, and the angled protruding shoulder 320, which fixedly secures the non-extrusion ring 140 to the principal element 28.

Figure 7:
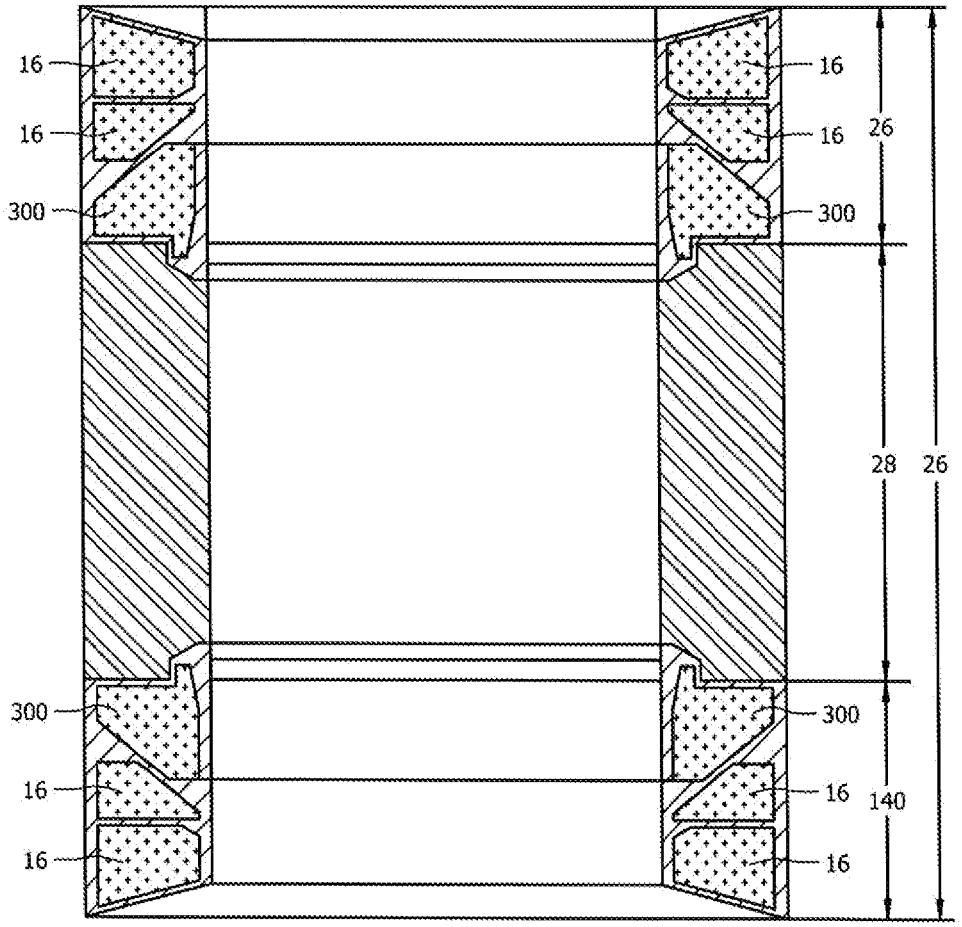
FIG. 7 is an assembled view of the packing element of FIG. 6A.

FIG. 7 is an assembled view of the packing element 26 of FIG. 6A. The assembled packing element 26 shows the relationship of the various parts of FIG. 6A when placed into a packer 10.

Figure 8A:
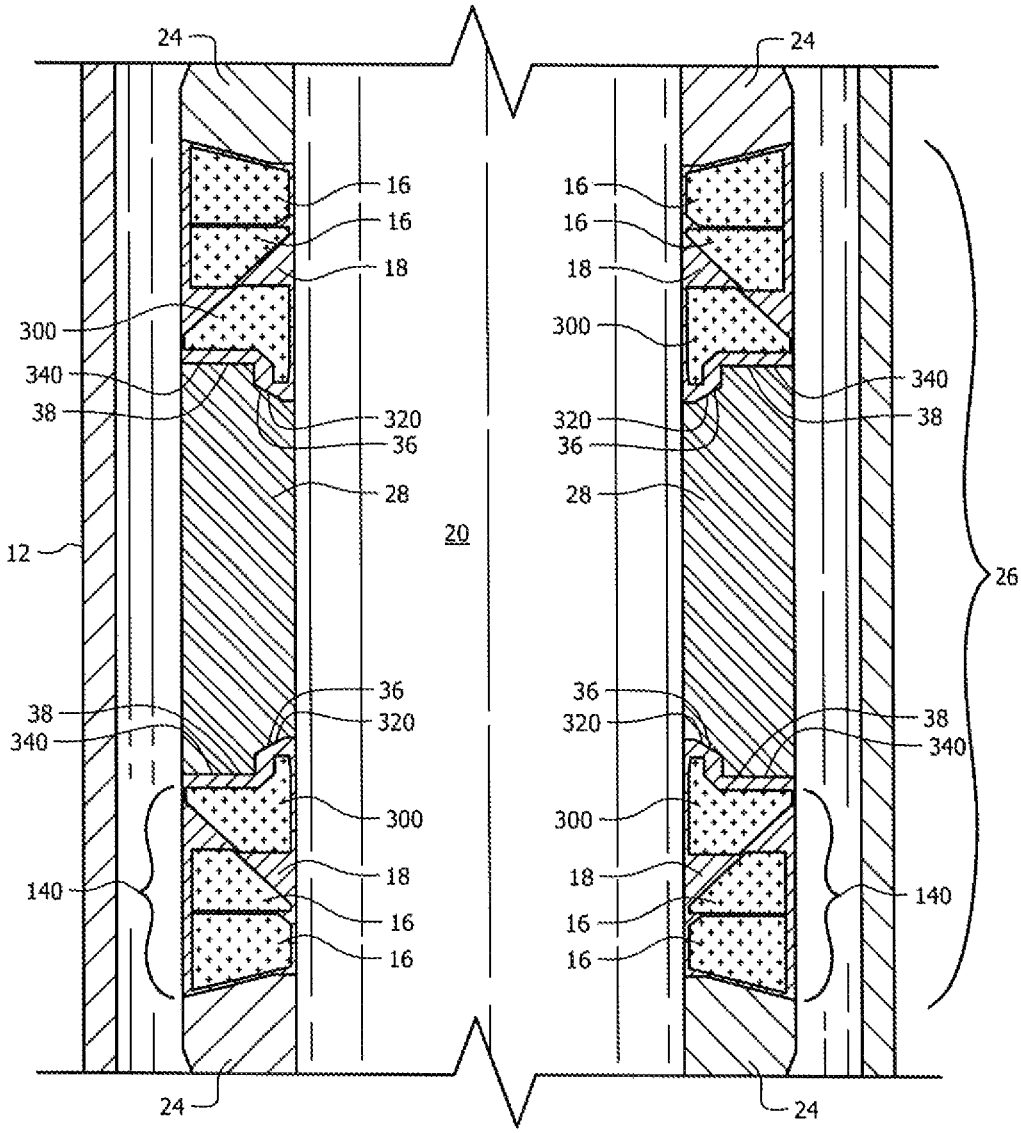
FIG. 8A is a sectional close-up view of a packing element in a retracted state according to a second embodiment of the present disclosure.

FIG. 8A is a sectional close-up view of a packing element 26 in a retracted state within a packer 10, according to a second embodiment of the present disclosure. The non-extrusion ring 140 is shown between the forcing cone 24 and the principal element 28. The protruding shoulder 320 of non-extrusion ring 140 is shown slidably disposed within recess 36 of principal element 28 and the flat base 340 of non-extrusion ring 140 is shown resting flush against shoulder 38 of principal element 28.

Figure 8B:
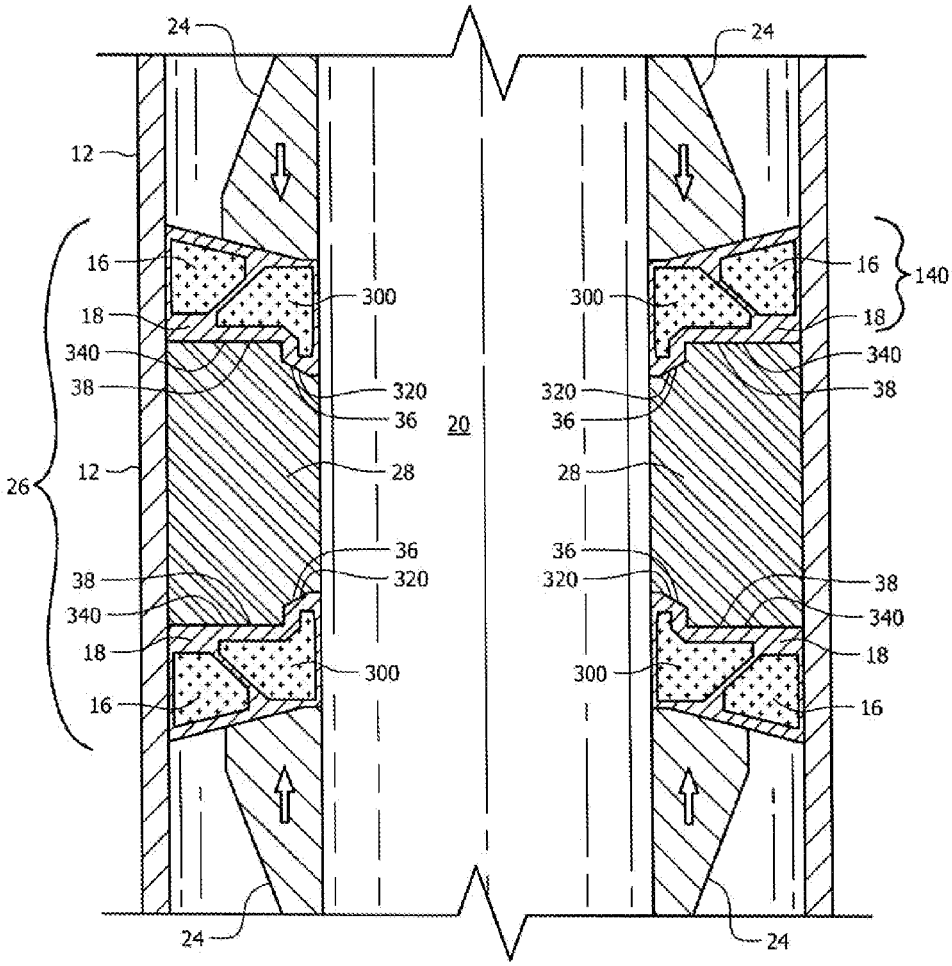
FIG. 8B is a sectional close-up view of a packing element in an engaged state according to a second embodiment of the present disclosure.

FIG. 8B is a sectional close-up view of the packing element 26 of FIG. 8A in an engaged state where forcing cones 24 are moved axially along the mandrel 20 towards each other, according to a second embodiment of the present disclosure. The inclined planes of forcing cones 24 have pushed against the non-extrusion ring 140, thereby forcing the rigid segments 16 outwards towards the conduit 12. Under this pressure, the conical support ring 300 of non-extrusion ring 140, which is enveloped in the elastomeric matrix 18, slides against the rigid segments 16 and up the mandrel 20. The conical support ring 300 fills the void created by the expanding rigid segments 16, further forcing the rigid segments 16 outwards towards the wall of the conduit 12, and forming a seal between the mandrel 20 and the conical support ring 300. In the engaged state, the non-extrusion rings 140 contain the principal element 28 from extruding between the forcing cones 24 and the conduit 12 or between the mandrel 20 and the conical support rings 300.

Figure 9A:
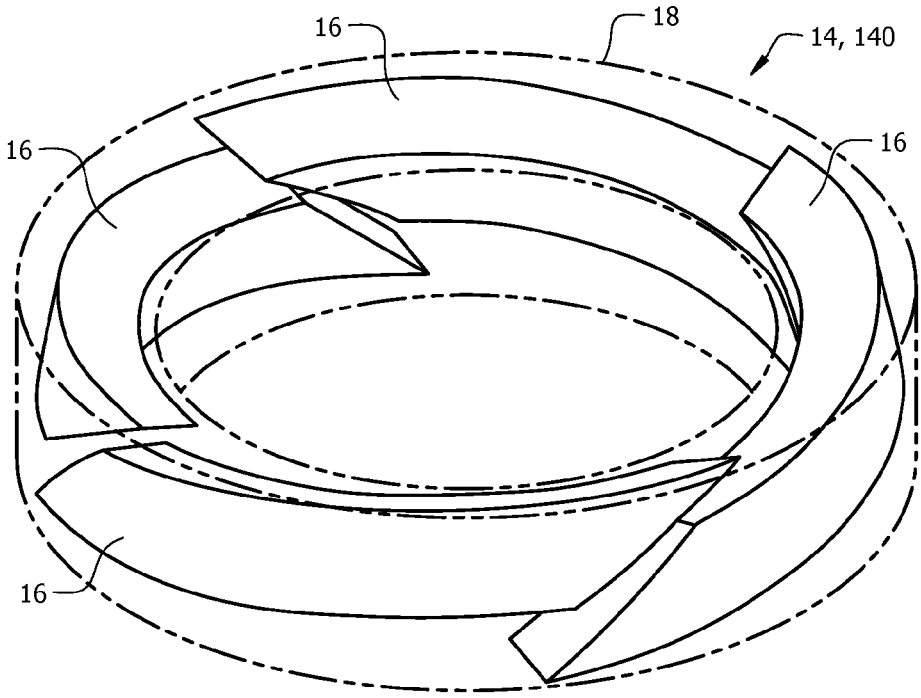
FIG. 9A is an isometric view of the segments within a non-extrusion ring in a retracted state.

FIG. 9A is an isometric view of the rigid segments 16 within the non-extrusion ring 14 or 140 in a refracted state. Rigid segments 16 are arranged within the elastomeric matrix 18 in a vertically overlapping fashion.

Figure 9B:
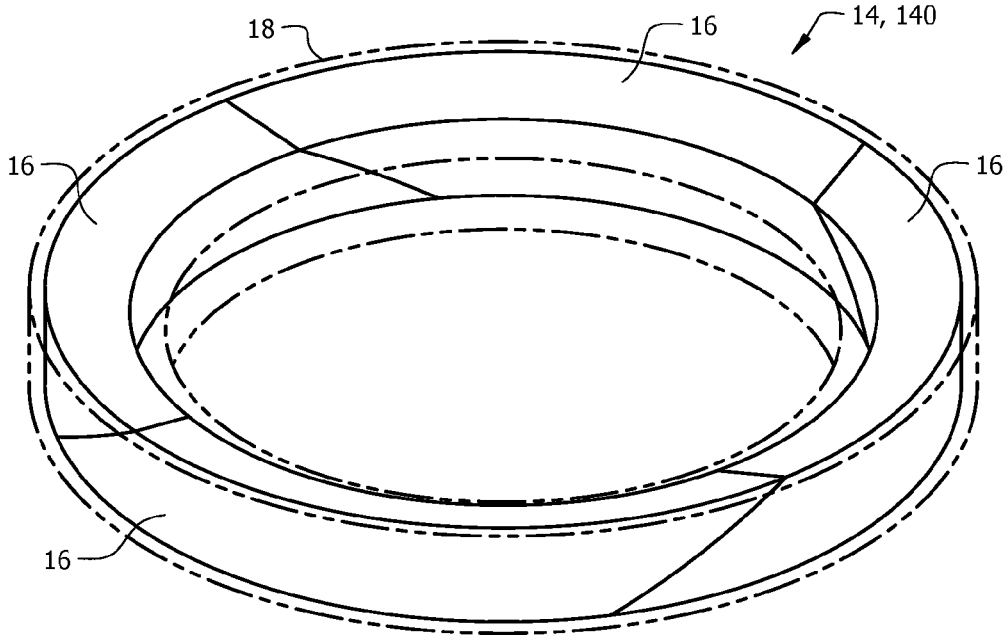
FIG. 9B is an isometric view of the segments within a non-extrusion ring in an engaged state.

FIG. 9B is an isometric view of the rigid segments 16 within a non-extrusion ring 14 or 140 in an engaged state. Rigid segments 16 have been fully expanded and form a near solid ring of rigid material within the elastomeric matrix 18. A comparison of FIG. 9A to FIG. 9B shows that rigid segments 16 may be formed by slicing a rigid ring of the desired size into multiple rigid segments 16 along a bias. The number of rigid segments 16 may be adjusted based on the desired movement between the rigid segments 16 and the support ring 30 or the conical support ring 300, and the distance the rigid segments 16 must move to engage the conduit 12. As the number of rigid segments 16 increases, the less movement and the more stable the packing element 26. Four rigid segments 16 are shown in FIGS. 9A and 9B, but the number of rigid segments 16 will be determined by the size of the packer system 10, 100 and the movement desired between the rigid segments 16 and the support ring 30 or the conical support ring 300. In some embodiments, four to ten rigid segments 16 may be utilized.

Rigid segments 16 and support ring 30 or conical support ring 300 may be made of multiple materials depending on the desired properties. Some examples would include metals, such as steel, copper, bronze, aluminum, brass, cast iron, composite bronze, or ductile metal, or rigid plastics, such as phynolic thermal resins and similar rigid plastics. Likewise, elastomeric matrix 18 may be made from a variety of elastomers such as vulcanized rubber, either natural or synthetic, of varying hardnesses or durometers. The selection of materials for the non-extrusion ring 14, 140 depends on the rigidity needed, the anticipated corrosiveness of the setting, the bonding between the elastomeric matrix 18 and rigid segments 16, and the speed with which the non-extrusion ring 14, 140 is expected to engage the conduit 12. All of these factors are balanced when selecting materials for the rigid segments 16 and elastomeric matrix 18 of a non-extrusion ring 14, 140. If appropriate, aluminum will be favored for rigid segments 16 because of its relatively high strength and ease of drillability after use.

It may be advantageous to set forth definitions of certain words and phrases used in this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A non-extrusion ring for sealing against the inner diameter of a casing, the non-extrusion ring comprising:

a plurality of segments arranged in a vertically overlapping manner, each segment having an outer surface, an inner surface, an upper surface and slanted end surfaces, the outer surfaces of the segments having a curvature that approximates the inner diameter of the casing;

a rigid conical support ring having an interior surface, an angled outer surface slidably disposed along and supporting each segment of the plurality of segments, and an exterior surface, the exterior surface having a flat base and a protruding shoulder; and a flexible matrix surrounding the support ring and the plurality of segments and maintaining the segments in the vertically overlapping manner while in a relaxed state, but allowing the segments to move radially when force is exerted on the non-extrusion ring.

2. The non-extrusion ring of claim 1, wherein the upper surfaces of the segments are slanted.

3. The non-extrusion ring of claim 1, further comprising a slanted upper surface of the non-extrusion ring.

4. The non-extrusion ring of claim 1, wherein the flexible matrix is vulcanized rubber.

5. The non-extrusion ring of claim 1, wherein the segments move radially under force to form a near solid ring of segments within the flexible matrix and against the inner diameter of the casing.

6. The non-extrusion ring of claim 1, wherein the segments are metal.

7. The non-extrusion ring of claim 6, wherein the metal is steel, aluminum, bronze, cast iron, or brass.

8. The non-extrusion ring of claim 6, wherein the segments are formed by slicing a rigid ring of metal.

9. The non-extrusion ring of claim 8, wherein the segments are sliced to have slanted end surfaces such that a first end of one segment overlaps a second end of an adjacent segment.

10. A sealing system comprising the non-extrusion ring of claim 1.

11. A method of forming a seal using the sealing system of claim 10, the method comprising:

exerting a force on the non-extrusion ring;

expanding the segments radially outward within the flexible matrix;

sealing the segments against the inner diameter of the casing; and sealing the conical support ring against an inner mandrel.

12. The method of claim 11, wherein the sealed segments prevent extrusion of a packing element between the casing and the sealing system; and wherein the sealed conical support ring prevents extrusion of the packing element between the inner mandrel and the sealing system.

13. The method of claim 12, further comprising the sealing system forming a seal to prevent extrusion of the packing element between the inner mandrel and the casing.

14. A packer for sealing a casing with an inner diameter, the packer comprising:

a mandrel having an outer diameter;

a plurality of slips securing the mandrel to the casing;

at least two forcing cones slidable along the mandrel, a forcing cone of the at least two forcing cones having an inclined face;

two non-extrusion rings, each between a forcing cone and a principal element, each non-extrusion ring having an upper surface and a lower surface and being comprised of:

a plurality of segments arranged in a vertically overlapping manner, each segment having an outer surface, an inner surface, an upper surface and slanted end surfaces, the outer surfaces of the segments having a curvature that approximates the inner diameter of the casing;

a rigid conical support ring having an interior surface, an angled outer surface slidably disposed along and supporting each segment of the plurality of segments, and an exterior surface, the exterior surface having a flat base and a protruding shoulder; and a flexible matrix surrounding the support ring and the plurality of segments and maintaining the segments in the vertically overlapping manner while in a relaxed state, but allowing the segments to move radially when force is exerted on the non-extrusion ring; and the principal element abutting the exterior surface of the support ring of each non-extrusion ring.

15. The packer of claim 14 wherein:

the forcing cone of the at least two forcing cones may move axially along the mandrel towards at least one of the two non-extrusion rings such that the inclined face of the forcing cone engages the plurality of segments and pushes the plurality of segments radially; and the conical support ring may move axially along the mandrel towards the plurality of segments further forcing the plurality of segments outwards radially and sealing the casing.

16. The packer of claim 15, wherein the segments of the at least one non-extrusion ring align with each other and engage the inner diameter of the casing.

17. The packer of claim 15, wherein the support ring slides into a space created by the expanding plurality of segments, to seal the casing.

18. The packer of claim 14, wherein the upper surfaces of the segments are slanted to mate with the forcing cone.

19. The packer of claim 14, wherein the flexible matrix is vulcanized rubber.

20. The packer of claim 14, wherein the segments move radially under force to form a ring of segments against the inner diameter of the casing.

* * * * *